US005125763A

United States Patent [19]

Seantier

[11] Patent Number: 5,125,763

[45] Date of Patent: Jun. 30, 1992

[54] JOINT FOR CONNECTING ROADWAY SLABS

[75] Inventor: Jacky Seantier, Lormaye, France

[73] Assignee: Freyssinet International (STUP), France

[21] Appl. No.: 487,939

[22] Filed: Mar. 5, 1990

[30] Foreign Application Priority Data

Mar. 3, 1989 [FR] France ..... 89 02807

[51] Int. Cl.[5] ..... E01C 11/02

[52] U.S. Cl. ..... 404/68; 404/69; 14/73.1

[58] Field of Search ..... 404/47, 67, 66, 64, 404/68, 69, 49; 14/16.5; 52/395, 396, 573

[56] References Cited

U.S. PATENT DOCUMENTS

| | | | |
|---|---|---|---|
| 3,375,763 | 4/1968 | Welch | 404/67 |
| 3,758,220 | 9/1973 | Hein | 404/67 |
| 3,862,810 | 1/1975 | Welch | 404/66 |
| 4,131,382 | 12/1978 | Hymo | 52/396 X |
| 4,572,702 | 2/1986 | Bone | 404/67 X |
| 4,885,885 | 12/1989 | Gottsching | 404/47 X |

FOREIGN PATENT DOCUMENTS

| | | | |
|---|---|---|---|
| 1271742 | 7/1968 | Fed. Rep. of Germany | 14/16.5 |
| 437397 | 11/1967 | Switzerland | 14/16.5 |

*Primary Examiner*—Ramon S. Britts
*Assistant Examiner*—Roger J. Schoeppel
*Attorney, Agent, or Firm*—Larson and Taylor

[57] ABSTRACT

A road joint is disclosed formed by two rigid frames (4) joined together by a flexible strip (2) formed by an elastomer body having in cross section the form of an upside-down truncated V with thick legs and reinforced by a central horizontal rigid plate (1). The frames are disposed on opposing sides of the center of the joint and each include a lower horizontal heel (3) on which a corresponding leg of the elastomer body rests and is adhered. Rigid plate (1) includes two lateral members slanted slightly with respect to the horizontal and the heels of the frames (4) have upper surfaces (8) parallel to these lateral members. The slanted heels (3) of the rigid frames (4) orient the legs of the flexible strip (2) such that vertical deformation of the flexible strip (2) is minimized.

6 Claims, 1 Drawing Sheet

JOINT FOR CONNECTING ROADWAY SLABS

FIELD OF THE INVENTION

The invention relates to road joints, namely to joints connecting together two roadway slabs or surfacing portions likely to undergo relative movements, said joints being each adapted so as to close at the top the gap which extends between the facing end edges of two such slabs, for providing running continuity in line with said gap, each being formed by two rigid frames connected together by a flexible strip of an elastomer material or similar adhering thereto, these two frames resting respectively on two shouldered steps formed in the two slabs on each side of the gap.

It relates more particularly to the case where the width of the gap is relatively great, namely on average about 50 to 500 mm, and may vary considerably.

It relates more particularly still to the case where the flexible strip is formed by an elastomer body having a cross section in the form of an upturned V or U with thick legs, and reinforced by a rigid plate embedded in this body and covering the gap and where each frame ends on the gap side in a horizontal lower heel on which the corresponding leg of the elastomer body rests.

BACKGROUND OF THE INVENTION

In known embodiments of the above joints, such as the one shown schematically in cross section in FIG. 1 of the accompanying drawings, plate 1 which reinforces the flexible strip 2 is flat and horizontal and so are the heels 3 of frames 4.

In this case, the mutual movements drawing the frames towards each other, shown symbolically by arrows F, and due to expansion of slabs 5 on which these frames rest, which movements tend to close gap 6 separating said slabs, result in plate 1 being raised as shown by arrow X and conversely.

These vertical movements of the median zone of the joint are only tolerable if their amplitude is small.

In practice, it is considered that the level of said median zone of the joint should not exceed by more than 2 mm the average level of the upper faces of the two slabs 5 so that a vehicle travelling rapidly over the joint does not cause unpleasant jolting of said vehicle. Now, in practice, when it is very hot and when the width of gap 6 is at a minimum, the difference in level may reach or even exceed 5 mm.

SUMMARY OF THE INVENTION

The object of the invention is in particular to overcome this drawback.

For this, the road joints according to the invention are essentially characterized in that the lower face of the rigid plate reinforcing their flexible strip is concave and defined laterally by two planes slanted slightly with respect to the horizontal and in that the heels of their frames have upper surfaces parallel to these planes.

In preferred embodiments, recourse is further had to one and/or the other of the following arrangements:

the slant angle of each plane slanted with respect to the horizontal is between 5° and 10°, being preferably about 8°;

the rigid plate comprises a flat central horizontal portion and is connected to two slanting lateral sections;

in a joint according to the preceding paragraph, the two lateral faces are thinner than the central portion;

the plate is covered with a slightly cambered elastomer coating;

in the free state of the joint, the lateral faces of each leg of the elastomer body forming the flexible strip are slanted with respect to the horizontal through angles between 30° and 75°.

In what follows, a preferred embodiment of the invention will be described with reference to the accompanying drawings in a way which is of course in no wise limitative.

DETAILED DESCRIPTION OF THE PREFERRED EMBODIMENT

Figure 1:
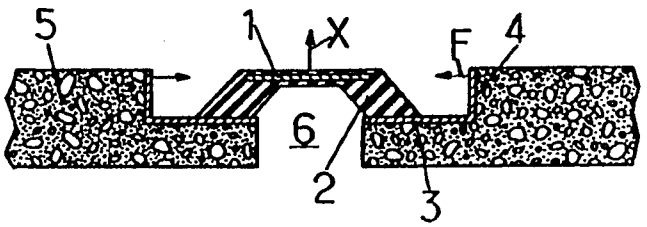
FIG.1. PRIOR ART
FIG. 1 shows in a schematic cross section a known road joint.

In the road joint shown in FIG. 2 we find again the elements 1 to 4 and 6 mentioned above in connection with FIG. 1 as well as the arrows F showing symbolically the mutual movement towards each other of the two frames 4.

This joint differs essentially from the preceding one by the two following points:

plate 1 which reinforces flexible strip 2 and is buried in this strip comprises here two lateral sections 7 which are slightly slanted with respect to the horizontal so as to form a sort of roof;

the upper face 8 of heels 3 of frames 4 on which the bases of the two legs of the strip are adhered are raised towards gap 6 so as to be substantially parallel to the facing faces of sections 7.

In order to obtain this latter result, the thickness of each heel 3 may increase progressively as far as its end edge, disposed in the vicinity of gap 6.

The two sections 7 are preferably joined together by a flat central portion 9 with horizontal parallel faces which extends over a width substantially equal to half the total width of plate 1 formed by these sections and this central portion.

The common angle $\alpha$ through which sections 7 and faces 8 are slanted with respect to the horizontal is between 5° and 10°, being preferably about 8°.

The elastomer body forming the flexible strip 2 is formed of two identical prismatic blocks having in cross section the general form of a parallelogram: the free faces of these blocks, namely those which are not adhered to sections 7 or faces 8, are slanted with respect to the horizontal by an angle between 30° and 75°.

Each of the above sections 7 is preferably thinner than the central portion 9 which it extends, which increases the vertical thickness of each block 2 without reducing the mechanical strength of the joint, considering that the latter works essentially in its central portion.

Figure 2:
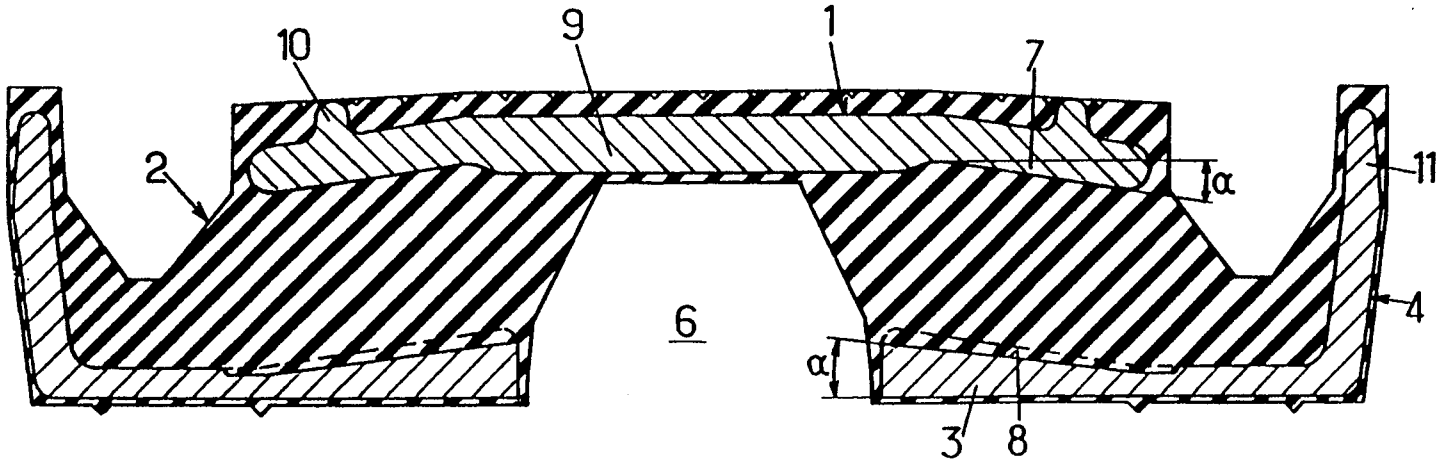
FIG. 2 shows, in vertical cross section, a road joint formed in accordance with the invention.

In FIG. 2 can be seen:

studs 10 integrally molded with plate 1 and projecting from the upper faces of sections 7, which studs are for centering said plate in its mold during manufacture of the joint by molding the elastomer body, which encases said plate completely, and two vertical walls 11 which each extend the end of a heel 3 upwards, the end the furthest away from gap 6, so as to form with this heel a frame 4.

Experience shows that with a joint of the above kind, the vertical movements of the central portion corresponding to maximum horizontal deformation of the joint, remain within acceptable tolerances, the amplitude of such movements being less than 2 mm on each side of a mean position.

Following which and whatever the embodiment adopted, a road joint is finally obtained whose construction, operation and advantages—particularly the absence of perceptible vertical deformation of the central zone even for extreme states of deformation of the joint—follow sufficiently from the foregoing.

As is evident and as it follows moreover already from what has gone before, the invention is in no wise limited to those of its modes of application and embodiments which have been more especially considered; it embraces, on the contrary, all variants thereof.

I claim:

1. A road joint formed by two rigid frames joined together by a flexible elastomer body having two legs and having, in cross-section, the form of a truncated upside-down V, said elastomer body reinforced by means of a central, generally horizontal, rigid plate having a lower face, said road joint having a center with said frames disposed on opposing sides of said center, said frames each including a lower heel on which a said leg of said elastomer body rests and to which it is adhered, said lower face of said rigid plate comprising two generally straight lateral sections, each slanted downwardly slightly with respect to the horizontal, and said heels of said rigid frames each having an upper surface generally parallel to the lateral section on its side of said center.

2. The road joint of claim 1, wherein said two lateral sections are slanted with respect to the horizontal between 5° and 10°.

3. The road joint of claim 1, wherein said rigid plate further includes a flat, central, horizontal portion between said two lateral sections.

4. The road joint of claim 3, wherein said two lateral sections are thinner than said central portion.

5. The road joint of claim 1, wherein said central rigid plate is covered with a slightly cambered elastomer coating.

6. The road joint of claim 1, wherein said legs of said elastomer body are slanted with respect to the horizontal by an angle between 30° and 75°.

* * * * *